US012171331B2

(12) United States Patent
Yao et al.

(10) Patent No.: US 12,171,331 B2
(45) Date of Patent: Dec. 24, 2024

(54) SHELF ASSEMBLY AND STORAGE CABINET

(71) Applicants: HEFEI HUALING CO., LTD., Anhui (CN); HEFEI MIDEA REFRIGERATOR CO., LTD., Anhui (CN); MIDEA GROUP CO., LTD., Guangdong (CN)

(72) Inventors: Nanfei Yao, Anhui (CN); Feng Wen, Anhui (CN); Yunho Yang, Anhui (CN)

(73) Assignees: HEFEI HUALING CO., LTD., Anhui (CN); HEFEI MIDEA REFRIGERATOR CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 168 days.

(21) Appl. No.: 17/793,582

(22) PCT Filed: Nov. 18, 2020

(86) PCT No.: PCT/CN2020/129752
§ 371 (c)(1),
(2) Date: Jul. 18, 2022

(87) PCT Pub. No.: WO2021/147495
PCT Pub. Date: Jul. 29, 2021

(65) Prior Publication Data

US 2023/0047342 A1 Feb. 16, 2023

(30) Foreign Application Priority Data

Jan. 20, 2020 (CN) ..... 202010065228.4

(51) Int. Cl.
*A47B 57/18* (2006.01)
*A47F 3/00* (2006.01)

(52) U.S. Cl.
CPC ..... *A47B 57/18* (2013.01); *A47F 3/00* (2013.01)

(58) Field of Classification Search
CPC ..... A47B 57/18; A47B 57/06; A47B 57/30; A47B 96/025; A47B 96/027; A47B 51/00;
(Continued)

(56) References Cited

U.S. PATENT DOCUMENTS 1,969,957 A * 8/1934 Zimmerman ..... A47B 47/04 312/107
3,371,968 A * 3/1968 George ..... A47B 88/493 312/333
(Continued)

FOREIGN PATENT DOCUMENTS

CN 2356562 Y 1/2000
CN 102301195 A 12/2011
(Continued)

OTHER PUBLICATIONS

CN218279200 Yao Figure and English abstract and claims (Year: 2023).*
CN209931908 English translation (Year: 2020).*

*Primary Examiner* — Janet M Wilkens
(74) *Attorney, Agent, or Firm* — Seed IP Law Group LLP

(57) ABSTRACT

Provided are a shelf assembly and a storage cabinet, which relate to the technical field of storage apparatuses. The shelf assembly includes: a plurality of shelves, mounting rods, the outer peripheral walls of which are provided with external threads in the axial direction, moving members corresponding to the shelves, and driving members corresponding to the moving members. The moving members are connected to the corresponding shelves; internal thread holes in threaded fit with the mounting rods are formed on the moving members; and the driving members are connected to the
(Continued)

corresponding moving members and are used for driving the moving members to rotate. The storage cabinet includes a cabinet body and the shelf assembly arranged in the cabinet body.

14 Claims, 5 Drawing Sheets

(58) Field of Classification Search
CPC ..... A47F 3/00; A47F 3/0486; F25D 25/04; F25D 25/02; F25D 25/024; F25D 11/00; F25D 2325/021
USPC ..... 108/106–108; 312/351, 408, 306
See application file for complete search history.

(56) References Cited

U.S. PATENT DOCUMENTS

| | | | | | |
|---|---|---|---|---|---|
| 6,363,738 | B2 * | 4/2002 | Nakajima | F25D 25/02 | 211/1.56 |
| 7,306,303 | B2 * | 12/2007 | Ritchie | A47B 51/00 | 248/244 |
| 8,226,184 | B2 * | 7/2012 | Kang | A47B 57/06 | 312/319.1 |
| 8,267,493 | B2 * | 9/2012 | Kim | F25D 25/024 | 108/106 |
| 2009/0255292 | A1 * | 10/2009 | Benz | A47B 57/06 | 700/275 |
| 2009/0261704 | A1 * | 10/2009 | Benz | F24C 15/16 | 312/293.1 |
| 2019/0075924 | A1 * | 3/2019 | Nuss | A47B 57/08 | |
| 2021/0088270 | A1 * | 3/2021 | Allgeier | A47B 51/00 | |

FOREIGN PATENT DOCUMENTS

| | | | | | |
|---|---|---|---|---|---|
| CN | 102667377 | A | | 9/2012 | |
| CN | 206056105 | U | | 3/2017 | |
| CN | 106568291 | A | | 4/2017 | |
| CN | 206600978 | U | * | 10/2017 | |
| CN | 108996098 | A | | 12/2018 | |
| CN | 208274396 | U | | 12/2018 | |
| CN | 109855379 | A | * | 9/2019 | |
| CN | 209377079 | U | | 9/2019 | |
| CN | 209931908 | U | * | 1/2020 | |
| CN | 111174524 | A | | 5/2020 | |
| CN | 111351303 | A | * | 6/2020 | F25D 11/00 |
| CN | 111664649 | A | * | 9/2020 | |
| CN | 112444042 | A | * | 3/2021 | F25D 11/02 |
| CN | 218279200 | U | * | 1/2023 | |
| JP | H07298963 | A | | 11/1995 | |
| JP | 2004173959 | A | | 6/2004 | |
| JP | 4111038 | B2 | * | 7/2008 | A47B 57/30 |
| JP | 4853131 | B2 | | 1/2012 | |
| KR | 20100085252 | A | | 7/2010 | |
| KR | 101878436 | B1 | * | 7/2018 | |
| WO | WO-2011080179 | A1 | * | 7/2011 | F25D 25/02 |
| WO | WO-2018086503 | A1 | * | 5/2018 | |
| WO | WO-2021174899 | A1 | * | 9/2021 | F25D 11/00 |

* cited by examiner

SHELF ASSEMBLY AND STORAGE CABINET

CROSS-REFERENCE TO RELATED APPLICATION

The present application claims priority to Chinese Application No. 202010065228.4, filed on Jan. 20, 2020, entitled "Shelf Assembly and Storage Cabinet", which is hereby incorporated by reference in its entity.

TECHNICAL FIELD

The present application relates to the technical field of storage apparatus, in particular to a shelf assembly and a storage cabinet.

BACKGROUND

At present, in order to adapt to items with different specifications, some high-end refrigerators are provided with lifting racks to adjust the height of shelves. However, in order to realize the independent adjustment of each shelf, the inner wall of the refrigerator needs to be provided with a set of lifting racks for each shelf, which not only increases the cost, but also creates a high installation difficulty in limited space of the refrigerator and affects the aesthetics.

SUMMARY

An objective of the present application is to solve at least one of the problems existing in the prior art or related art. Therefore, the present application provides a shelf assembly with a simple structure, low cost and a good-looking appearance.

The present application further provides a storage cabinet.

In a first aspect, the shelf assembly according to the embodiments of the present application includes:

a plurality of shelves;

a mounting rod, a peripheral wall of which is formed with an external thread along an axis direction;

movement components corresponding to the shelves, where each of the movement components is connected to the corresponding shelf and formed with an internal thread hole matching with the external thread of the mounting rod; and driving components corresponding to the movement components, where each of the driving components is connected to the movement component and configured to drive an rotating component of the movement component to rotate.

According to the shelf assembly provided by the embodiments of the present application, the plurality of shelves can be adjusted independently merely by arranging a set of mounting rods, which not only saves the cost, but also facilitates mounting, and provides good-looking and concise appearance. In addition, either in the process of adjusting the height of the shelves or when the shelves are fixed, the shelves will not slide down along the mounting rods because of load bearing under the joint constraint of the external threads of the mounting rods and the internal threads of the movement components, which ensures the load-bearing demand of the shelves.

In addition, the shelf assembly according to the embodiments of the present application, can further include the following additional features:

according to an embodiment of the present application, the shelf assembly further includes:

a guide rod, provided in parallel with the mounting rod; where the guide rod is formed with a first connecting portion along a height direction; and sliding blocks, where one side of each sliding block is formed with a second connecting portion slidably matched with the first connecting portion, and the other side thereof is connected with the shelf.

According to an embodiment of the present application, the first connecting portion is a bulge formed on a surface of the guide rod, and the second connecting portion is a sliding groove formed on a surface of the sliding block; or, the first connecting portion is a sliding groove formed on the surface of the guide rod, and the second connecting portion is a bulge formed on the surface of the sliding block.

According to an embodiment of the present application, the sliding groove is a swallowtail groove.

According to an embodiment of the present application, an inner wall of the sliding groove or an outer wall of the bulge is embedded with a plurality of rolling balls.

According to an embodiment of the present application, the movement component and the sliding block are both connected to a connecting plate, and the connecting plate is detachably connected to the shelf.

According to an embodiment of the present application, the connecting plate includes a top plate and a side plate, and a top of the side plate is connected to a side wall of the top plate; the top plate is connected to a top surface of the movement component, the side plate is connected to a side wall of the sliding block, and the side plate is detachably connected to the shelf.

According to an embodiment of the present application, the shelf is provided with a first inserting plate and a second inserting plate, the side plate is provided with a first inserting hole for socketing the first inserting plate and a second inserting hole for socketing the second inserting plate, an end of the first inserting plate distal to the shelf is formed with a limiting portion extending downward, and the limiting portion is hooked on the side plate.

According to an embodiment of the present application, the movement component and the driving component constitute a screw stepping motor.

According to an embodiment of the present application, the shelf is provided with control buttons electrically connected to the corresponding driving component.

According to an embodiment of the present application, the movement component includes a housing and a rotating component provided in the housing, the housing is formed thereon with a through hole extending through a longitudinal direction, the rotating component is rotatably provided in the through hole by a bearing, the rotating component is formed thereon with an internal thread hole extending through the longitudinal direction, and the driving component is configured to drive the rotating component to rotate.

According to an embodiment of the present application, the driving component includes a handle and a conical gear provided in the housing, an outer wall of the rotating component is opened with a tooth groove meshed with the conical gear, and an end of the handle is inserted into the housing to connect with a rotating shaft of the conical gear.

In a second aspect, the storage cabinet according to the embodiments of the present application, includes a cabinet body and the shelf assembly mentioned above, and the shelf assembly is provided in the cabinet body.

According to an embodiment of the present application, the storage cabinet is a refrigerator or a retail cabinet.

The one or more solutions according to the embodiments of the present application have at least one of the following beneficial effects.

In the present application, the driving component directly drives the rotating component of the corresponding movement component to rotate since the mounting rod is fixed. The movement component can transform its own rotational motion into linear motion by continuously matching with the external thread of the mounting rod in the process of rotation, thereby driving the shelf connected to it to move along the axial direction of the mounting rod. Therefore, the shelf assembly according to the present application can realize independent adjustment of the plurality of shelves only by arranging a set of mounting rods. In other words, all the shelves can share the same set of mounting rods, thus it is only needed to control the corresponding driving component to drive the rotating component of the movement component to rotate when adjusting the height of the shelves. Therefore, the present application not only saves the cost, but also facilitates mounting, and provides good-looking and concise appearance. In addition, since the mounting rods and the movement components are connected through thread, either in the process of adjusting the height of the shelves or when the shelves are fixed, the shelves will not slide down along the mounting rods because of load bearing under the joint constraint of the external threads of the mounting rods and the internal threads of the movement components, which ensures the load-bearing demand of the shelves.

Additional aspects and advantages of the present application are set forth, in part, from the following description, and the part will become clear from the following description, or is learned by practice of the present application.

BRIEF DESCRIPTION OF DRAWINGS

To more clearly illustrate the embodiments of the present application or prior art, accompanying drawings used in the description of the embodiments or the prior art are briefly introduced below. It should be noted that, the drawings in the following description only show some embodiments of the present application. For those of ordinary skill in the art, other drawings may also be obtained according to these drawings without creative effort.

REFERENCE NUMERALS

Figure 1:
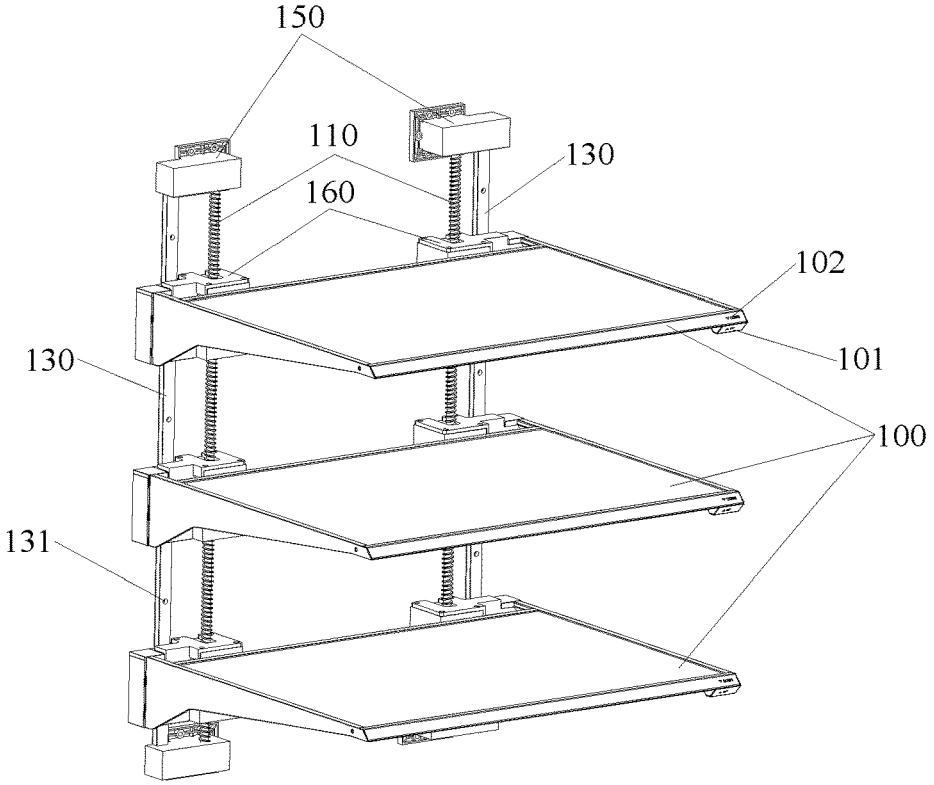
FIG. 1 is a perspective view of a shelf assembly from an angle according to an embodiment of the present application.
Figure 2:
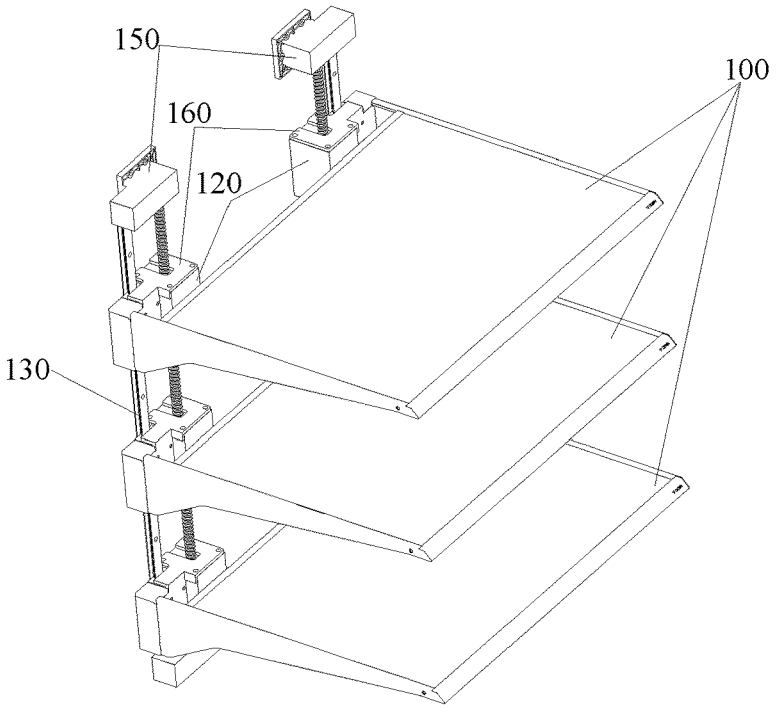
FIG. 2 is a perspective view of a shelf assembly from another angle according to an embodiment of the present application.

100: shelf; 101: up button; 102: down button; 103: first inserting plate;

1031: limiting portion; 104: second inserting plate; 110: mounting rod; 120: movement component;

130: guide rod; 131: mounting hole; 132: bulge; 140: sliding block; 141: sliding groove;

150: mounting seat; 160: connecting plate; 161: top plate; 1611: avoidance gap;

162: side plate; 1621: first inserting hole; 1622: second inserting hole; 170: rolling ball;

180: cabinet body.

DETAILED DESCRIPTION OF THE EMBODIMENTS

In order to make the objectives, solutions and advantages of the embodiments of the present application clearer, the solutions of the embodiments of the present application is clearly and completely described in combination with the accompanying drawings of the embodiments of the present application. The embodiments described are a part of the embodiments of the present application, rather than all the embodiments. Based on the embodiments of the present application, all other embodiments obtained by those of ordinary skill in the art without creative effort fall within the scope of protection of the present application.

In the description of the present application, it is to be noted that, the orientation or positional relations specified by terms such as "central", "longitudinal", "transverse", "upper", "lower", "front", "back", "left", "right", "vertical", "horizontal", "top", "bottom", "inner", "outer" and the like, are based on the orientation or positional relations shown in the drawings, which is merely for convenience of description of the present application and to simplify description, but does not indicate or imply that the stated devices or components must have the particular orientation and be constructed and operated in a particular orientation, and thus it is not to be construed as limiting the present application. Furthermore, the terms "first", "second", "third" and the like are only used for descriptive purposes and should not be construed as indicating or implying a relative importance.

In the description of the present application, it is to be noted that unless explicitly specified and defined otherwise, the terms "connected to" and "connected" shall be understood broadly, for example, it may be either fixedly connected or detachably connected, or can be integrated; it may be either mechanically connected, or electrically connected; it may be either directly connected, or indirectly connected through an intermediate medium. The specific meanings of the terms above in the present application can be understood by a person skilled in the art in accordance with specific conditions.

In the embodiments of the present application, unless otherwise expressly specified and defined, a first feature is "on" or "under" a second feature can refer to that the first feature is directly contacted with the second feature, or the first feature is indirectly contacted with the second feature through an intermediate medium. And further, the first feature is "on", "above" and "over" the second feature can refer to that the first feature is directly above or obliquely above the second feature, or simply refer to that the level height of the first feature is higher than that of the second feature. The first feature is "under", "below" and "beneath" the second feature can refer to that the first feature is directly below or obliquely below the second feature, or simply refer to that the level height of the first feature is lower than that of the second feature.

In the description of this specification, description with reference to the terms "one embodiment", "some embodiments", "an example", "specific example", "some examples" and the like, refers to that specific features, structures, materials or characteristics described in combination with an embodiment or an example are included in at least one embodiment or example according to the embodiments of the present application. In this specification, schematic representations of the above terms are not necessarily directed to a same embodiment or example. Furthermore, the particular features, structures, materials or characteristics described can be combined in any suitable manner in any one or more embodiments or examples. In addition, those skilled in the art may combine the different embodiments or examples described in this specification, as well as the features of the different embodiments or examples, without conflicting each other.

Referring to FIG. 1 to FIG. 8, an embodiment of the present application provides a shelf assembly, including a mounting rod 110, a plurality of shelves 100, movement components 120 corresponding to the shelves 100 and driving components corresponding to the movement components 120. A peripheral wall of the mounting rod 110 is formed with an external thread along an axis direction. Each of the movement components 120 is connected to the corresponding shelf 110, and formed with an internal thread hole matching the external thread of the mounting rod 110. The driving component is connected to the movement component 120 and configured to drive an rotating component of the movement component 120 to rotate.

The driving component directly drives an rotating component of the corresponding movement component 120 to rotate since the mounting rod 110 is fixed in the shelf assembly. The rotation of the rotating component of the movement component 120 can transform its own rotational motion into linear motion by continuously matching with the external thread of the mounting rod 110 in the process of rotation, thereby driving the shelf 100 connected to it to move along the axial direction of the mounting rod 110. Therefore, the shelf assembly in the present application can realize independent adjustment of the plurality of shelves 100 merely by arranging a set of mounting rods 110. In other words, all the shelves 100 can share the same set of mounting rods 110, thus it is only needed to control the corresponding driving component to drive the rotating component of the movement component 120 to rotate when adjusting the height of the shelves 100. Therefore, the present application not only saves the cost, but also facilitates mounting, and provides good-looking and concise appearance. In addition, since the mounting rods 110 and the movement component 120 are connected through thread, either in the process of adjusting the height of the shelves 100 or when the shelves 100 are fixed, the shelves 100 will not slide down along the mounting rods 110 because of the load bearing under the joint constraint of the external threads of the mounting rods 110 and the internal threads of the movement components 120.

Figure 3:
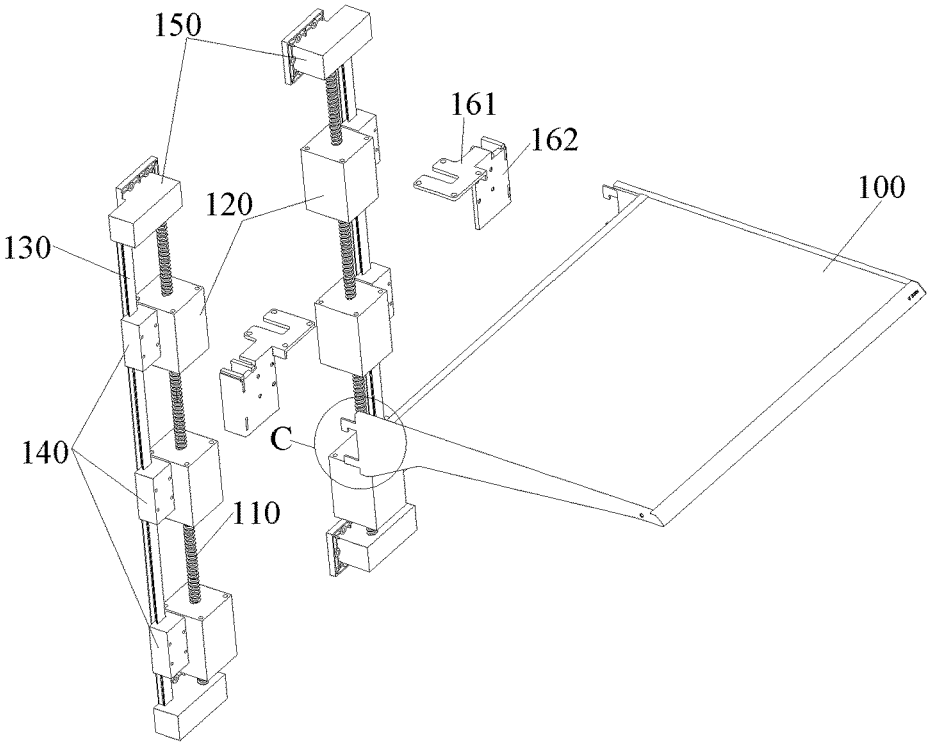
FIG. 3 is an exploded view of a shelf assembly according to an embodiment of the present application.
Figure 4:
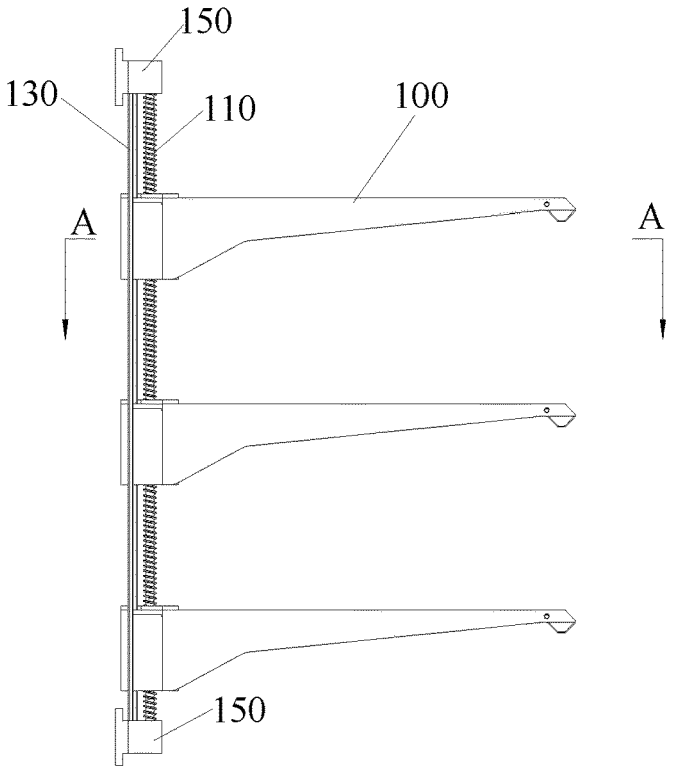
FIG. 4 is a side view of a shelf assembly according to an embodiment of the present application.
Figure 5:
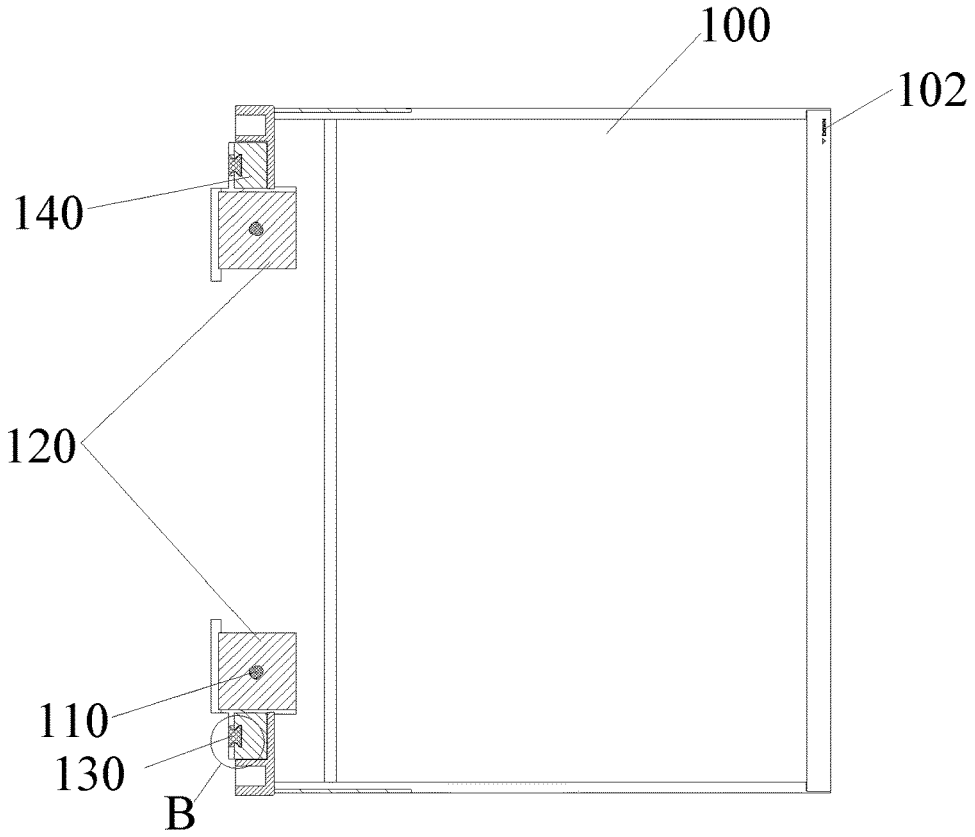
FIG. 5 is a sectional view of FIG. 4 at A-A.
Figure 6:
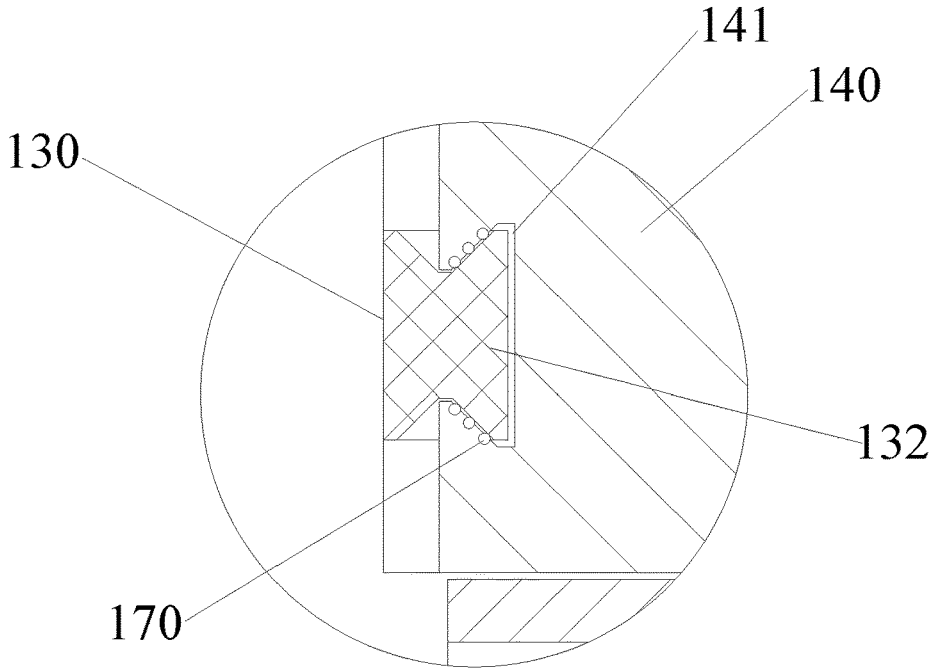
FIG. 6 is an enlargement view of FIG. 5 at B.

As shown in FIG. 3, the shelf assembly further includes a guide rod 130 and sliding blocks 140. The guide rod 130 is arranged in parallel with the mounting rod 110, where the guide rod 130 is formed with a first connecting portion 132 along its height direction; one side of the slide bock 140 is formed with a second connecting portion 141 slidably matched with the first connecting portion 132, and the other side of the sliding block 140 is connected with the shelf 100. It can be seen from the above that the movement components 120, the sliding blocks 140 and the shelves 100 move synchronously. When the movement components 120 move, the sliding blocks 140 and the shelves 100 also move together with them.

It should be noted that there are many modes to realize sliding connection between the guide rod 130 and the sliding block 140, for example:

mode 1: the first connecting portion is a bulge 132 formed on a surface of the guide rod 130, and the second connecting portion is a sliding groove 141 formed on a surface of the sliding block 140; and mode 2: the first connecting portion is a sliding groove formed on the surface of the guide rod, and the second connecting portion is a bulge formed on the surface of the sliding block.

In order to prevent the bulge 132 from separating from the sliding groove 141 during the sliding process of the sliding block 140, the sliding groove 141 can be a swallowtail groove, at which point the bulge 132 is a swallowtail structure matching the swallowtail groove. In addition, in order to reduce the resistance in the sliding process of the sliding block 140, an inner wall of the sliding groove 141 or an outer wall of the bulge 132 is embedded with a plurality of rolling balls 170. In other words, the inner wall of the sliding groove 141 or the outer wall of the bulge 132 is provided with dimples corresponding to the rolling balls 170 one-to-one, and one part of the rolling ball 170 is embedded in the dimple, and the other part of the rolling ball 170 protrudes out of the dimple. Therefore, during the sliding process of the sliding block 140, the rolling balls 170 continuously rotate under the action of friction.

In addition, in order to facilitate installation, the movement component 120 and the sliding block 140 are both connected to a connecting plate 160. Where the connecting plate 160 can be welded on the shelf 100, or detachably connected to the shelf 100. For example, as shown in FIG. 3, the connecting plate 160 includes a top plate 161 and a side plate 162, and a top of the side plate 162 is connected to a side wall of the top plate 161; the top plate 161 is connected to a top surface of the movement component 120, the side plate 162 is connected to a side wall of the sliding block 140, and the side plate 162 is detachably connected to the shelf 100.

Figure 7:
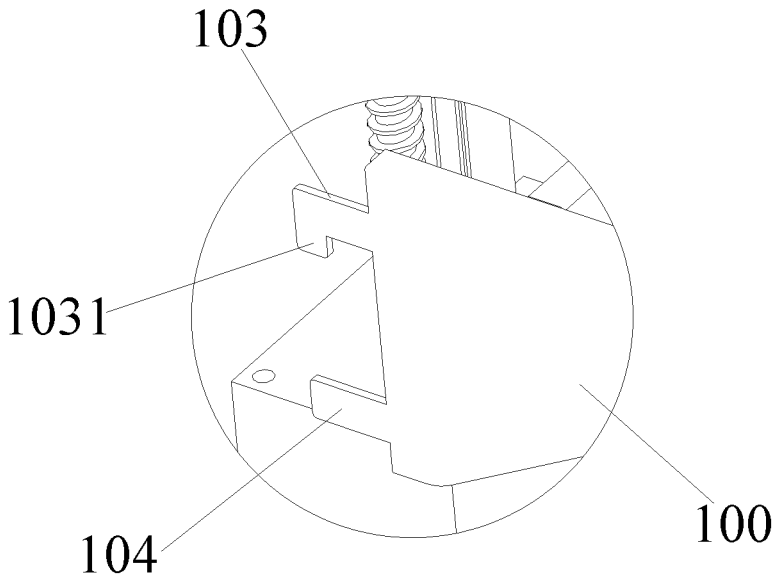
FIG. 7 is an enlargement view of FIG. 3 at C.
Figure 8:
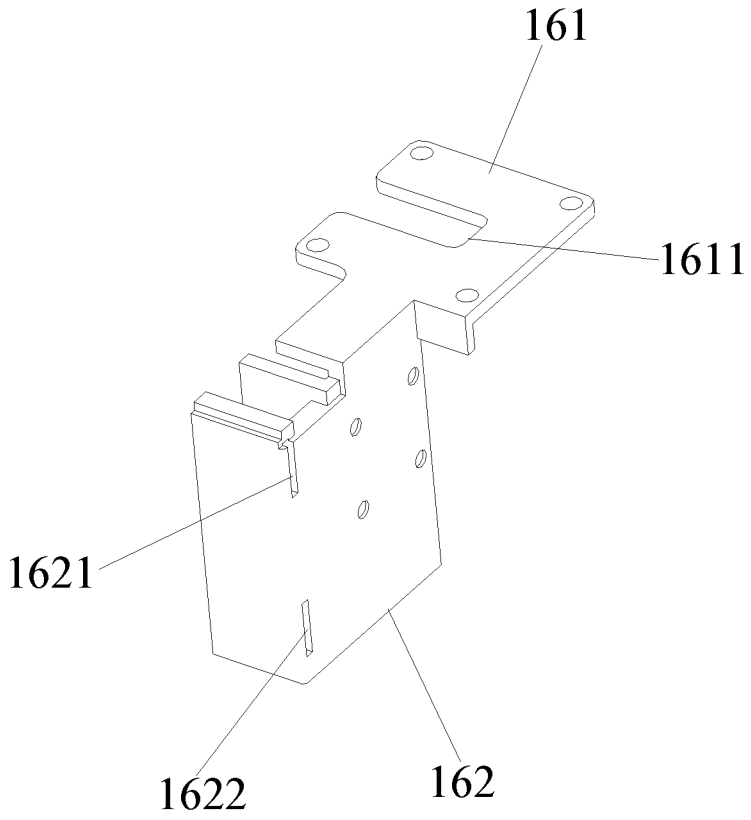
FIG. 8 is a structural diagram of a connecting plate according to an embodiment of the present application.

Specifically, as shown in FIG. 7 to FIG. 8, the shelf 100 is provided with a first inserting plate 103 and a second inserting plate 104, the side plate 162 is provided with a first inserting hole 1621 for socketing the first inserting plate 103 and a second inserting hole 1622 for socketing the second inserting plate 104, an end of the first inserting plate 103 distal to the shelf 100 is formed with a limiting portion 1031 extending downward, and the limiting portion 1031 is hooked on the side plate 162.

The top plate 161 can be connected to the top surface of the movement component 120 through screws, that is, the top plate 161 can be provided with a plurality of first through holes, and the top of the movement component 120 can be provided with first thread holes corresponding to the first through holes. The side plate 162 can also be connected to the side wall of the sliding block 140 through screws, that is, the side plate 162 can be provided with a plurality of second through holes, and the top surface of the sliding block 140 can be provided with second thread holes corresponding to the second through holes.

Further, the top plate 161 is provided with an avoidance gap 1611 corresponding to the mounting rod 110, so that the mounting rod 110 passes through the top plate 161 through the avoidance gap 1611 when the top plate 161 is mounted on the top of the movement component 120.

The driving component can be automatic or manual. Specifically, it is as follows.

1. automatic. At this time, the driving component is an electric device. For example, as shown in FIG. 3, the driving component and the movement component 120 constitute a screw stepping motor. It should be noted that since the screw stepping motor belongs to the prior art, its specific structure and working principle will not be described here.

Further, in order to facilitate the user's operation, the shelf 100 is provided with control buttons electrically connected to the driving component. For example, the control buttons include an up button 101 and a down button 102. Therefore, the user only needs to press the up button 101 when the shelf 100 needs to be raised, and the driving component will drive the shelf 100 to move up by a specified distance along the mounting rod 110 every time the up button 101 is pressed. Similarly, the user only needs to press the down button 102 when the shelf 100 needs to be lowered. The driving component will drive the shelf 100 to move down by a specified distance along the mounting rod 110 every time the down button 102 is pressed. By providing control buttons on the shelves 100, the shelf assembly according to the embodiment of the present application not only facilitates a user to control the movement of the shelves 100, but also enable the user to adjust without diverting their sight during the whole process compared with the control buttons provided on other components. That is, the user does not need to quickly divert their sight to observe the movement of the shelves 100 after operating the control button.

In addition, in order to ensure the accuracy of adjustment, the specified distance of the driving component moving along the mounting rod 110 is usually very small every time the up button 101 or the down button 102 is pressed, thus the user needs to press the up button 101 or the down button 102 multiple times when the shelf 100 needs to move a large distance. Therefore, in order to improve the user experience and reduce the times of pressing the up button 101 or the down button 102, the control button further includes a setting button, which is electrically connected to the driving component, and the side wall of the shelf 100 is further provided with a display screen electrically connected to the setting button at this time, where the setting button is configured to set the specified distance of the driving component moving along the mounting rod 110 when the up button 101 or the down button 102 is pressed; the display screen is configured to display the specified distance. Therefore, the user can set the specified distance for a single movement of the driving component according to the distance that shelf 100 needs to move. In order to facilitate the user's operation, the control button can also be provided on the front side of the shelf 100, where the "front side" of the shelf 100 is based on the mounting direction of the shelf 100, and the side of the shelf 100 facing the cabinet door is the front side, and the side facing away the cabinet door is the rear side after the shelves 100 is mounted in a cabinet body 180.

2. manual. At this time, the moving component 120 includes a housing and a rotating component provided in the housing, the driving component includes a handle and a conical gear provided in the housing; the housing is provided thereon with a through hole extending through the longitudinal direction, the rotating component is rotatably provided in the through hole by a bearing, the rotating component is provided thereon with an internal thread hole through the longitudinal direction, the outer wall of the rotating component is provided with a tooth groove meshed with the conical gear, and an end of the handle is inserted into the housing to connect with a rotating shaft of the conical gear. Therefore, the user only needs to rotate the handle clockwise when the shelf 100 needs to be raised. Since the handle is connected to the rotating shaft of the conical gear, and the conical gear is meshed with the groove of the rotating component, the handle, the conical gear and the rotating component move synchronously. Therefore, when the user rotates the handle, the conical gear rotates together with it, thereby driving the rotating component to rotate simultaneously. Since the rotating component matches with the thread of the mounting rod 110 through its internal thread hole, during the rotation process of the rotating component, as the internal thread of the rotating component constantly matches with the external thread of the mounting rods 110 located above the shelves 100, the rotational motion of the rotating component is transformed into a linear motion, that is, the rotating component drives the shelves 100 to move upwards through the housing at this time. Conversely, the user only needs to rotate the handle counterclockwise when the shelves 100 needs to be lowered. It should be noted that, the direction of the movement component 120 moving along the mounting rod 110 when rotating the handle clockwise or counterclockwise can be set by setting the rotating direction of the external thread on the mounting rod 110.

Figure 9:
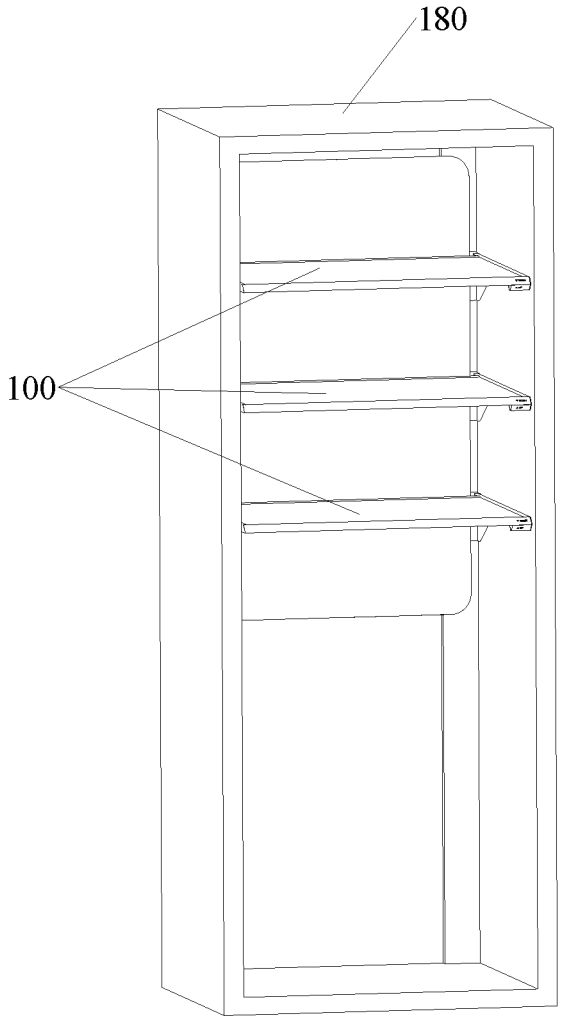
FIG. 9 is a perspective view of a storage cabinet according to an embodiment of the present application.

Referring to FIG. 9, an embodiment of the present application further provides a storage cabinet, which includes a cabinet body 180 and the shelf assembly mentioned above, and the shelf assembly is provided in the cabinet body 180. Where the storage cabinet can be, but not limited to, a refrigerator or a retail cabinet. The structure and principle of the shelf assembly in this embodiment are the same as those in the above embodiments, and will not be described in detail in this embodiment.

The shelf assembly in the present application can realize independent adjustment of the plurality of shelves 100 only by using a set of mounting rods 110, which not only saves the cost, but also facilitates mounting, and provides good-looking and concise appearance. In addition, either in the process of adjusting the height of the shelves 100 or when the shelves 100 are fixed, the shelves 100 will not slide down along the mounting rods 110 because of load bearing under the joint constraint of the external threads of the mounting rods 110 and the internal threads of the movement components 120, which ensures the load-bearing demand of the shelves.

Taking a refrigerator as an example, the back plate of the refrigerator is provided with two parallel mounting rods 110, each mounting rod 110 is equipped with a guide rod 130, the end of the mounting rod 110 and the end of the corresponding guide rod 130 are fixed on the back plate of the refrigerator through a mounting seat 150, the movement components 120 and the sliding blocks 140 are connected to back sides of the corresponding shelves 100 through the connecting plates 160. In order to improve the stability of the guide rod 130, the guide rod 130 is provided with a plurality of mounting holes 131 at intervals along the height direction thereof, and the back plate of the refrigerator is provided with thread holes corresponding to the mounting holes 131 one-to-one. Therefore, during installation, the guide rod 130 and the mounting rod 110 can be fixed on the back plate of the refrigerator through the mounting seat 150 first, and then screws are screwed into the guide rod 130. Specifically, one end of each screw is passed through the mounting hole 131 and screwed into the corresponding thread hole, so that the guide rod 130 can be firmly fixed on the inner wall of the refrigerator to prevent it from being skewed during use.

The mounting rod 110 and the guide rod 130 can also be fixed on the left and right sides of the inner wall of the refrigerator in addition to being fixed on the back plate of the refrigerator. Besides, the number of mounting rod 110 and guide rod 130 can be two or more.

Finally, it should be noted that the above embodiments are only used to illustrate the solutions of the present application, rather than limiting the solutions. Although the present application is described in detail with reference to the above embodiments, those of ordinary skill in the art should understand that: they may still modify the solutions recorded in the above embodiments, or make equivalent replacements to some of the features; these modifications or replacements do not make the essence of the corresponding solutions depart from the scope of the solutions of various embodiments of the present application.

What is claimed is:

1. A shelf assembly, comprising:

a plurality of shelves;

a mounting rod, a peripheral wall of the mounting rod including an external thread along an axis direction;

movement components corresponding to the shelves, wherein each of the movement components is coupled to a corresponding shelf and including an internal thread hole matching the external thread of the mounting rod;

a guide rod, positioned in parallel with the mounting rod;

sliding blocks coupled to the guide rod;

a plurality of connecting plates, each connecting plate of the plurality of connecting plates being coupled to a sliding block of the sliding blocks and a movement component of the movement components corresponding to the sliding block; and driving components corresponding to the movement components, wherein each of the driving components is coupled to a rotating component of the movement components and configured to drive the rotating component to rotate with respect to the external thread of the mounting rod so that the movement component moves up or down along an axis of the mounting rod.

2. The shelf assembly according to claim 1, wherein the guide rod includes a first connecting portion along a height direction; and wherein one side of each sliding block includes a second connecting portion slidably matched with the first connecting portion, and another side of each sliding block is coupled with a corresponding shelf.

3. The shelf assembly according to claim 2, wherein the first connecting portion is a bulge formed on a surface of the guide rod, and the second connecting portion is a sliding groove formed on a surface of the sliding block; or wherein the first connecting portion is a sliding groove formed on the surface of the guide rod, and the second connecting portion is a bulge formed on the surface of the sliding block.

4. The shelf assembly according to claim 3, wherein the sliding groove is a swallowtail groove.

5. The shelf assembly according to claim 3, wherein an inner wall of the sliding groove or an outer wall of the bulge is embedded with a plurality of rolling balls.

6. The shelf assembly according to claim 2, wherein a connecting plate of the plurality of connecting plates is detachably coupled to a corresponding shelf.

7. The shelf assembly according to claim 6, wherein the connecting plate comprises a top plate and a side plate, and a top of the side plate is coupled to a side wall of the top plate, the top plate is coupled to a top surface of the movement component, the side plate is coupled to a side wall of the sliding block, and the side plate is detachably coupled to the corresponding shelf.

8. The shelf assembly according to claim 7, wherein the corresponding shelf includes a first inserting plate and a second inserting plate, the side plate includes a first inserting hole for socketing the first inserting plate and a second inserting hole for socketing the second inserting plate, an end of the first inserting plate distal to the corresponding shelf includes a limiting portion extending downward, and the limiting portion is hooked on the side plate.

9. The shelf assembly according to claim 1, wherein the movement component and the driving component constitute a screw stepping motor.

10. The shelf assembly according to claim 1, wherein each shelf of the plurality of shelves is provided with control buttons electrically coupled to the driving component.

11. The shelf assembly according to claim 1, wherein the movement component comprises a housing and the rotating component is provided in the housing, the housing is formed thereon with a through hole extending through a longitudinal direction, the rotating component is rotatably provided in the through hole, the rotating component is formed thereon with the internal thread hole extending through the longitudinal direction, and the driving component is configured to drive the rotating component to rotate.

12. The shelf assembly according to claim 11, wherein the driving component is structured to be manually operated.

13. A storage cabinet, comprising a cabinet body and the shelf assembly according to claim 1, wherein the shelf assembly is provided in the cabinet body.

14. The storage cabinet according to claim 13, wherein the storage cabinet is a refrigerator or a retail cabinet.

* * * * *